United States Patent [19]

Moog

[11] Patent Number: 4,893,696

[45] Date of Patent: Jan. 16, 1990

[54] WORKING CATWALK FOR BRIDGE INSPECTION APPARATUSES

[75] Inventor: Alfons Moog, Untersiggingen, Fed. Rep. of Germany

[73] Assignee: Rita Moog née Schlick, Deggenhausertal, Fed. Rep. of Germany

[21] Appl. No.: 222,117

[22] Filed: Jul. 20, 1988

[30] Foreign Application Priority Data

Jul. 20, 1987 [DE] Fed. Rep. of Germany ..... 3723925

[51] Int. Cl.[4] ..... E04G 3/08

[52] U.S. Cl. ..... 182/223; 182/113; 182/63

[58] Field of Search ..... 182/113, 223, 222, 63; 14/69.5, 71.1

[56] References Cited

U.S. PATENT DOCUMENTS

| | | | |
|---|---|---|---|
| 1,489,556 | 4/1924 | Thomson | 14/69.5 |
| 2,290,535 | 7/1942 | Cavins | 182/179 |
| 2,337,674 | 12/1943 | Miller | 182/223 X |
| 3,023,831 | 3/1962 | Bevis | 182/223 X |
| 3,908,793 | 9/1975 | Vaughn'et al. | 182/223 X |
| 4,475,625 | 10/1984 | Clements | 182/113 |

FOREIGN PATENT DOCUMENTS

| | | | |
|---|---|---|---|
| 81388 | 6/1983 | European Pat. Off. | 14/71.1 |
| 1540735 | 2/1979 | United Kingdom | 14/69.5 |

*Primary Examiner*—Alvin C. Chin-Shue

*Attorney, Agent, or Firm*—Spencer & Frank

[57] ABSTRACT

A working catwalk, in particular for bridge inspection apparatuses, comprising a floor section and a balustrade on each longitudinal side, to and having a variable width. The floor section consists of a center floor section, extending in the longitudinal center, and lateral additional floors. The balustrades are connected in an articulated manner to the center floor section via cantilever struts which can be pivoted out laterally, the axes of the joints connecting the struts to the center floor running parallel to one another and approximately perpendicularly to the working surface. Alternatively, the balustrades can also be designed as self reinforcing girders.

8 Claims, 2 Drawing Sheets

WORKING CATWALK FOR BRIDGE INSPECTION APPARATUSES

BACKGROUND OF THE INVENTION

The invention relates to a working catwalk, in particular for bridge inspection apparatuses, comprising a floor section and a balustrade on each longitudinal side.

Known working catwalks usually have a U-shaped cross-section, the balustrades representing the U-legs and the floor section the U-web. The constructions are aimed at an adequate rigidity at the lowest possible weight. The width is fixed from the outset and cannot be changed.

For especially extensive reconstruction work on bridges, scaffolds having working surfaces which must be especially wide are necessary. The widths required are substantially larger than the overall width of 2.50 m permitted for transportation by vehicles on public highways.

SUMMARY OF THE INVENTION

The object of the invention is to teach a relatively light working catwalk which, despite oversized width, can be transported on public roads.

Starting from a working catwalk of the generic category designated at the beginning, this object is achieved according to the invention when the floor section consists of a center floor section, extending in the longitudinal center, and lateral additional floors attached to balustrades connected in an articulated manner to the center floor section via cantilever struts which can be pivoted out laterally, the pivot axes running parallel to one another and approximately perpendicularly to the center floor section.

The cantilever struts, each of which has the same configuration, are arranged preferably at the same distances apart on the longitudinal sides of the center floor section. The floor-side and the balustrade-side joint axes of a row of cantilever struts in each case lie in a common plane so that the cantilever struts and the balustrades connecting them can be moved together like a parallelogram, for example by means of one or more working cylinders.

If the cantilever struts have been folded as far as possible towards the center floor section, the working catwalk has an overall transporting width of 2.50 m at most. The balustrades shield the center floor on both sides so that the working catwalk can also be used as a narrow working catwalk in this folded position. On the other hand, if the cantilever struts have been swung out in the transverse direction, the balustrades are at the largest mutual distance apart. By covering the cantilever struts with floor panels or additional floors of large area which rest on the center floor section for transporting, this center floor strip is expanded on both sides to form an especially wide working surface.

The center floor section is conveniently designed as an elongated girder which has a walk-on covering on its upper side. The girder preferably has a rectangular cross-section and is best designed as a truss. But a continuous U-profile or box profile is also suitable. As a result of such a robust substructure, at least the center area of the working surface can be subjected to high weight-loading, which is desired for heavy reconstruction or for replacing bridge bearings. The cantilever struts articulated on such a girder can likewise consist of a truss. They preferably have the outer contour of a right-angled triangle and, with one cathetus, are articulated in a pivotable manner on the girder so that the opposite triangle point articulated on the balustrade lies approximately at the level of the floor covering.

An advantageous further development of the working catwalk described is that the balustrades are firmly connected to one additional floor each. In this arrangement, in particular in the case of the girder described above, the additional floors can rest in a displaceable manner on the cantilever struts and/or the center floor section.

A working catwalk is thereby created which in use, for example on a bridge, can be set to any working width. When the cantilever struts are swung in, the thin additional floors slide on the center floor and move one over the other in the final state, and provision can be made by a suitable edge design to ensure that the additional floors do not run into one another. The additional floors should logically not be wider than the center floor. Moreover, the rigid attachment of the additional floors to the associated balustrade relieves and simplifies the connection of the balustrade joints to the cantilever struts without the protective function of the balustrade, i.e. its angular rigidity against bending over outwards, being impaired.

Instead of designing the center floor section as a girder and in this way giving the working catwalk as a whole the required rigidity, the balustrades can also be designed as girders, for example as a supporting lattice. This makes it possible in particular to substantially reduce the height of the center floor section and thus also the height of the cantilever struts.

BRIEF DESCRIPTION OF THE FIGURES

Exemplary embodiments of the invention are described below with reference to the drawing, in which, in detail.

DETAILED DESCRIPTION OF EXEMPLARY EMBODIMENTS

Figure 1:
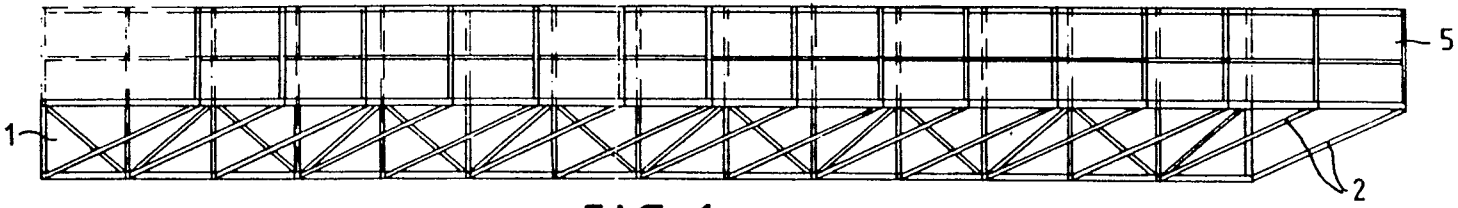
FIG. 1 is, a side view of a working catwalk having parts which can be pivoted out laterally for widening.

The working catwalk according to a first embodiment illustrated in FIGS. 1 to 4 has as a constructional substructure a girder (1) which consists of a truss and has a rectangular box profile in cross-section. On both sides of this elongated girder (1), triangular cantilever struts (2, 3), likewise inherently braced, are pivotably mounted about axes which are vertical in the position of use. The pivot bearings are designated in FIG. 4 by (4). The cantilever struts sections (2) on one side of the girder (1) and the cantilever struts sections (3) on the other side are in each case connected to one other sections of the same side by balustrades (5, 6) and in fact by joints (7), likewise on vertical axis, at the tips of the cantilever struts. The balustrades (5, 6) consist of horizontal bars and vertical posts and are preferably covered with a wire net. The joints (7) each sit at the lower end of the balustrade posts. By means of actuating cylinders (5a and 6a) (FIG. 2), which are articulated at one end of the girder (1) between the longitudinal beam of the girder and the relevant balustrade (5, 6), the cantilever struts can be pivoted by virtually 90° between a transverse or extended indicated by broken lines in FIG. 2, and a position folded towards the girder, indicated by solid lines according to FIG. 2. Consequently, the overall width of the working catwalk can be varied between 2.50 m and 6.00 m.

Figure 2:
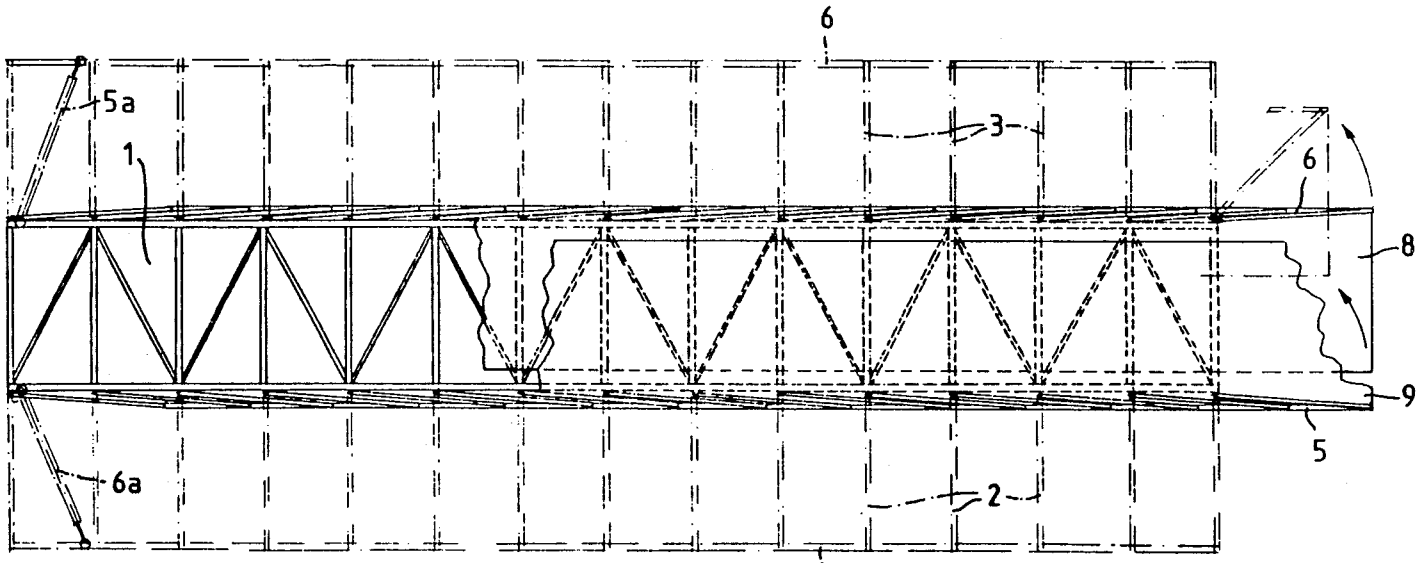
FIG. 2 is a plan top view of the working catwalk according to FIG. 1.
Figure 3:
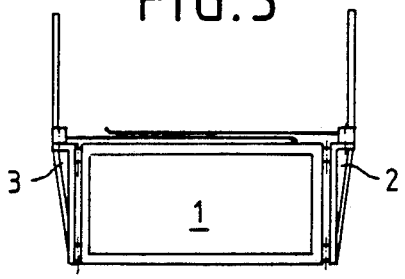
FIG. 3 is a cross-section of the working catwalk in the transporting position.
Figure 4:
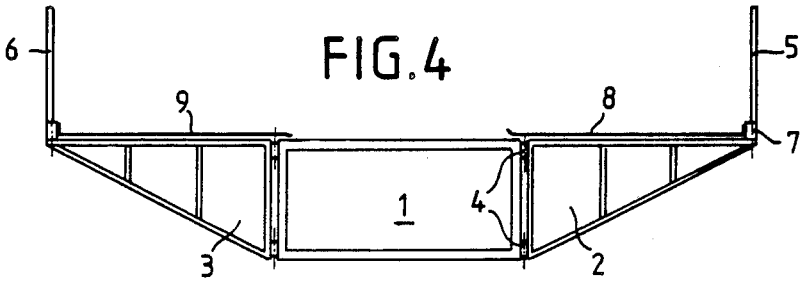
FIG. 4 is a cross-section of the working catwalk having swung-out parts.

The girder (1) is covered at the top with a floor covering, generally at 25. On the other hand, FIGS. 2, 3 and 4 show additional floors (8 and 9) of virtually the same width as the girder (1) which are firmly connected to the balustrades (5 and 6) as well as to the halves of the joint (7) on the balustrade side and substantially help to stiffen the balustrades. In the folded-out position, these additional floors (8 and 9) overlap the center floor over a narrow area. If the cantilever struts (2, 3) are folded towards the girder (1), the additional floors slide in a curved movement constantly parallel to themselves. After a pivot angle of slightly more than 45°, the edges of the additional floors (8 and 9) facing one another coincide, provision being made by suitable edge bevels or other auxiliary means to ensure that they do not run into one another. On the contrary, in the course of the further pivoting movement, the additional floor (8) comes down upon the additional floor (9) so that in the transporting position finally reached (FIG. 3) all three floors rest one on top of the other.

The girder (1) is designed for a loading of 5 tonnes at a concentrated load of 1 tonne. Thus the working catwalk can also be used in particular for replacing bridge bearings. In order to draw closer to the piers with the center floor section capable of high loading, an additional floor (8 or 9), for example, can be swung in. The center floor then accommodates the heavy apparatuses or auxiliary vehicles, while the second additional floor is available for the movement of personnel and for lighter materials. A particular advantage of the variable working catwalk described is that the alternative widening does not require any additional height above the working catwalk.

Figure 5:
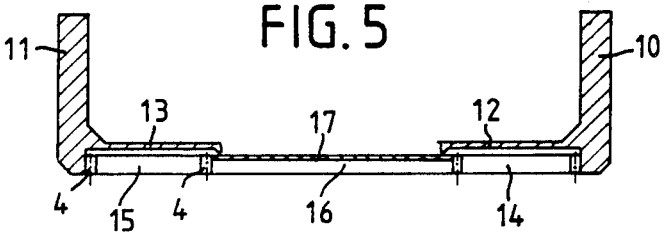
FIG. 5 is a cross-section of another variant of a working catwalk, variable in width, in the swung-out state.

In the alternative exemplary embodiment in FIG. 5, the main supporting function is performed by the balustrades (10 and 11). In the schematic form of representation selected, this is intended to be illustrated by their greater thickness. An additional floor (12, 13) is firmly connected at right angles to each of the two balustrades. Cantilever struts (14, 15) located thereunder, here made of tubular section, connect the balustrades (10, 11) to a center floor section (16) which consists of a lattice frame and is covered with a covering (17). Here, too, joints are designated by (4). The additional floors (12, 13) are narrower than in the first example so that they do not overlap when pivoted together. Since the load-bearing capacity of the cantilever struts (14, 15), as a result of their smaller height, is likewise smaller than in the first example, the additional floors (12, 13) are constructed in such a way that they do not rest on the center floor section but obtain their load-bearing capacity solely from their attachment to the load-bearing balustrades (10, 11). The center floor section (16, 17) is likewise supported by the balustrades (10, 11) via the cantilever struts (14, 15).

Figure 6:
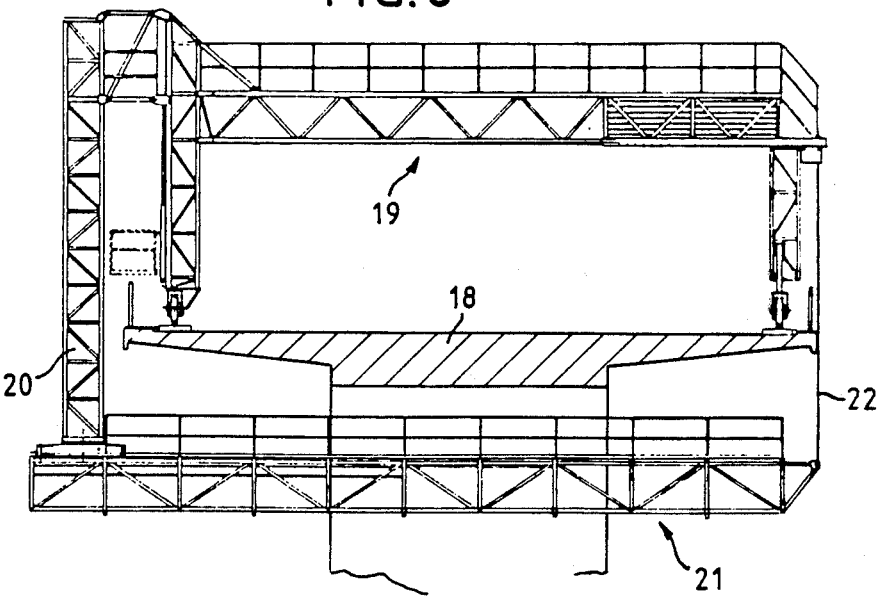
FIG. 6 shows a bridge inspection apparatus having a similar working catwalk.

FIG. 6 shows a preferred exemplary embodiment of a bridge inspection apparatus in which the working catwalk described above can be used. Located on a bridge (18) shown in cross-section is a gantry (19) which can be moved in the longitudinal direction of the bridge and from which a lifting tower (20) protrudes downwards on one side of the bridge (18). A working catwalk (21) similar to the working catwalk described above is attached to the lower end of the lifting tower (20). It extends horizontally through beneath the bridge and, with its free end, is suspended on the other side of the bridge by means of at least one rope (22) on the gantry (19).

I claim:

1. A catwalk, comprising:

a central frame section, a central floor section attached to said central frame section extending a set longitudinal and lateral distance in a horizontal plane, first and second lateral frame sections each attached to said central section at plurality of pivotal joints, each joint rotatable about an axis perpendicular to said horizontal plane, and said lateral frame sections being movable between a retracted position and an extended position, and first and second lateral floor sections attached to said first and second lateral frame sections and overlapping said central floor section when said lateral frame sections are in said retracted position.

2. The catwalk of claim 1, wherein said lateral frame sections include:

horizontal members each attached at a first end to a respective pivotal joint, vertical members pivotally attached to a second end of said horizontal members, said lateral floor sections are attached to said vertical members.

3. The catwalk of claim 2, wherein said lateral floor sections are attached to said vertical members at a first edge and are supported by said central floor section at a second edge.

4. The catwalk of claim 2, wherein pivoting of said horizontal members about said respective pivotal joints moves said lateral floor sections laterally in the plane of said center floor section.

5. The catwalk of claim 2, wherein said center frame includes an elongated structural girder having an essentially rectangular cross-section, said central floor extending along an upper surface of said girder each joint having an upper end adjacent said upper surface and a lower end adjacent a lower girder surface, and said pivotal joints extending vertically along the side of said girder, and said horizontal members are attached to said upper end of said pivotal joints.

6. The catwalk of claim 5, wherein said lateral frame members further include truss members extending from said lower end of said pivotal joints to said second end of said horizontal members.

7. The catwalk of claim 2, wherein said vertical lateral frame members include an elongated structural member having an essentially rectangular vertical cross-sectional configuration.

8. The catwalk of claim 7, wherein said central floor section is supported by said lateral floor sections.

* * * * *